US011865408B2

(12) United States Patent
Liang et al.

(10) Patent No.: US 11,865,408 B2
(45) Date of Patent: Jan. 9, 2024

(54) SWIMMING CAP WHICH PREVENTS WATER FROM ENTERING EARS

(71) Applicants: Jacko Liang, Guangzhou (CN); Josh Liang, Guangzhou (CN)

(72) Inventors: Jacko Liang, Guangzhou (CN); Josh Liang, Guangzhou (CN)

(73) Assignee: Guangzhou Vanguard Watersports Products Co., Ltd., Guangzhou (CN)

( * ) Notice: Subject to any disclaimer, the term of this patent is extended or adjusted under 35 U.S.C. 154(b) by 0 days.

(21) Appl. No.: 17/334,844

(22) Filed: May 31, 2021

(65) Prior Publication Data

US 2021/0402260 A1 Dec. 30, 2021

(30) Foreign Application Priority Data

Jun. 30, 2020 (CN) ..... 202021242976.7

(51) Int. Cl.
*A42B 1/0188* (2021.01)
*A42B 1/12* (2006.01)
*A63B 33/00* (2006.01)

(52) U.S. Cl.
CPC ..... *A63B 33/00* (2013.01); *A42B 1/0188* (2021.01); *A42B 1/12* (2013.01)

(58) Field of Classification Search
CPC ..... A42B 1/12; A42B 1/0188; A42B 3/16; A42B 3/185; A63B 33/00; A63B 71/10; A63B 2244/108; A41D 27/24
See application file for complete search history.

(56) References Cited

U.S. PATENT DOCUMENTS 2,115,368 A * 4/1938 Lustberg ..... B29C 66/729 428/57
2,625,683 A * 1/1953 Roth ..... A42B 3/12 2/6.1
3,456,263 A * 7/1969 Aileo ..... A42B 3/16 381/372
3,471,865 A * 10/1969 Molitoris ..... A42B 3/16 2/423
3,479,668 A * 11/1969 Bigler ..... A42B 1/02 2/200.2
3,535,710 A * 10/1970 Aileo ..... A42B 3/166 2/209
3,784,984 A * 1/1974 Aileo ..... A42B 3/10 2/909

(Continued)

*Primary Examiner* — Jillian K Pierorazio
(74) *Attorney, Agent, or Firm* — Alexander Chen, Esq.

(57) ABSTRACT

A swimming cap which prevents water from entering ears has a swimming cap main body; the swimming cap main body has a left side and a right side, each of which is symmetrically provided with an ear enclosing part for accommodating a human ear; each of the ear enclosing parts has an outer wall which protrudes outwards from an outer wall of the swimming cap main body; each of the ear enclosing parts has an inner wall which forms an enclosing space for enclosing the human ear which protrudes outwards from an inner wall of the swimming cap main body; each of the enclosing spaces has an outer edge which is provided with a waterproof edge in shape of an inclined trumpet at a connecting portion with the swimming cap main body. The present invention is simple and compact in structure and highly practical.

3 Claims, 4 Drawing Sheets

(56) References Cited

U.S. PATENT DOCUMENTS 3,789,427 A * 2/1974 Aileo ..... A42B 3/10 2/423
4,803,109 A * 2/1989 Saniscalchi ..... B29C 66/43 112/440
4,951,319 A * 8/1990 Phillips, Jr. ..... A42B 7/00 2/209.12
6,415,449 B2 * 7/2002 Duplock ..... B32B 5/026 112/419
2001/0008027 A1 * 7/2001 Duplock ..... B32B 27/12 2/69
2007/0082165 A1 * 4/2007 Barrett ..... B32B 27/12 428/57
2007/0124849 A1 * 6/2007 Williams ..... B32B 27/322 2/275
2009/0282602 A1 * 11/2009 Lepage ..... B29C 66/03242 2/82
2010/0151176 A1 * 6/2010 Ly ..... A41H 43/04 428/61
2010/0199411 A1 * 8/2010 Kaiser ..... A63B 33/00 2/446
2010/0215889 A1 * 8/2010 Cienski ..... B29C 66/1122 156/60
2011/0209265 A1 * 9/2011 Komada ..... A42B 1/048 2/205
2011/0214218 A1 * 9/2011 Bonamer ..... A41D 27/00 2/243.1
2014/0289936 A1 * 10/2014 Schalles ..... A63B 71/10 2/410
2015/0224738 A1 * 8/2015 Gallagher ..... B29C 66/72343 428/221
2016/0143385 A1 * 5/2016 Krissman ..... H04R 1/10 224/576
2016/0309824 A1 * 10/2016 Ulian ..... A42B 1/12
2018/0214311 A1 * 8/2018 Kimock ..... B05D 3/007
2019/0029354 A1 * 1/2019 Cecchi ..... A42B 3/16

* cited by examiner

SWIMMING CAP WHICH PREVENTS WATER FROM ENTERING EARS

BACKGROUND OF THE INVENTION

The present invention relates to the technical field of water sports equipment and more specifically relates to a swimming cap which prevents water from entering ears.

When swimming in a swimming pool, wearing a swimming cap is not only a basic gear but also a basic etiquette. By wearing a swimming cap, it is possible to prevent hairs from falling into the water to block and pollute the swimming pool; it is also effective in protecting hairs, reducing damages done to the hairs by the pool water, reducing resistance and thus increasing swimming speed.

Existing swimming caps are not provided with isolated portions for enclosing human ears. When a swimmer wears a swimming cap during swimming, as silicone swimming caps are not highly waterproof, some water still seeps from the lower opening to the head or even the ears, making it extremely uncomfortable for the swimmer. Therefore, a swimming cap with better waterproof capability is highly anticipated.

BRIEF SUMMARY OF THE INVENTION

It is an object of the present invention to overcome the technical deficiencies of the prior art, namely the poor waterproof capability of swimming caps in the prior art which results in water seeping to the head or even the ears easily and causing extreme discomfort to swimmers.

To solve the above technical problems, the present invention provides the following technical solutions:

A swimming cap which prevents water from entering ears comprising a swimming cap main body; the swimming cap main body has a left side and a right side, each of which is symmetrically provided with an ear enclosing part for accommodating a human ear; each of the ear enclosing parts has an outer wall which protrudes outwards from an outer wall of the swimming cap main body; each of the ear enclosing parts has an inner wall which forms an enclosing space for enclosing the human ear which protrudes outwards from an inner wall of the swimming cap main body; each of the enclosing spaces has an outer edge which is provided with a waterproof edge in shape of an inclined trumpet at a connecting portion with the swimming cap main body.

Further, each of the waterproof edges is a soft edge.

Further, the waterproof edges and the swimming cap main body are integrally formed.

Further, the swimming cap main body and the ear enclosing parts are integrally formed.

Further, a head portion waterproof edge which is inclined inwards is provided at a lower opening of the swimming cap main body.

Further, the head portion waterproof edge is a soft edge, and the head portion waterproof edge and the swimming cap main body are integrally formed.

Compared with the prior art, the present invention has the following beneficial effects:

The present invention provides a swimming cap which prevents water from entering ears. When in use, the ear enclosing parts and the waterproof edges provided in the inner side isolate the ears from other parts of the head, so that water would not enter the ears during swimming. The head portion waterproof edge increases waterproof level and reduces water seeping. The present invention is simple and compact in structure and highly practical.

BRIEF DESCRIPTION OF THE DRAWINGS

In order to illustrate the technical proposal of implementations of the embodiments of the present invention or existing technology clearly, the accompanying drawings which are necessary for describing the embodiments or existing technology are briefly described below. Obviously, the accompanying drawings described below are only embodiments of the present invention; the persons skilled in the art could devise other accompanying drawings in accordance with said accompanying drawings without any inventive effort.

In the figures, 1 denotes the swimming cap main body, 2 denotes the ear enclosing part, 3 denotes the waterproof edge and 4 denotes the head portion waterproof edge.

DETAILED DESCRIPTION OF THE INVENTION

The present invention is clearly and comprehensively explained herein with reference to the following detailed embodiments. Obviously, the embodiments that are described herein are only some of the possible embodiments of the present invention but not the only embodiments of the present invention. All other embodiments obtainable without any inventive effort by a person skilled in this field of art based on the embodiments of the present invention disclosed herein should also fall within the scope of protection of the present invention.

Embodiment 1

Figure 1:
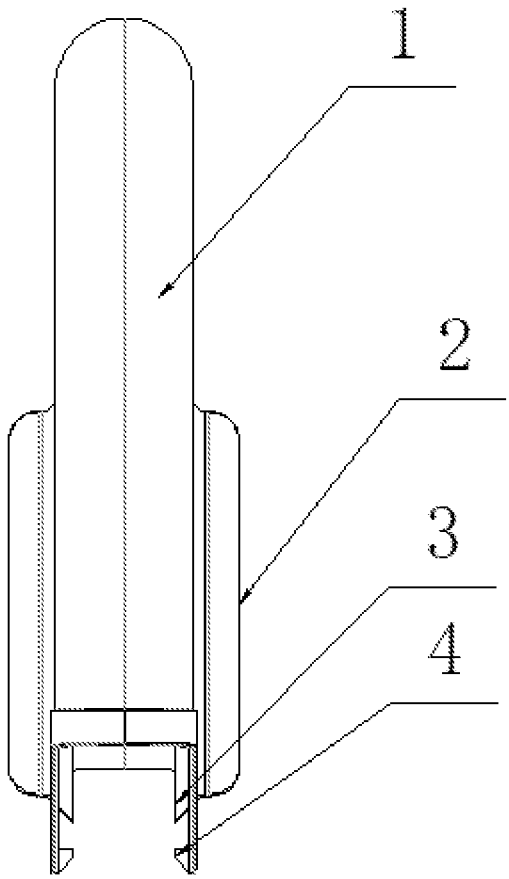
FIG. 1 is a front view of the present invention.
Figure 2:
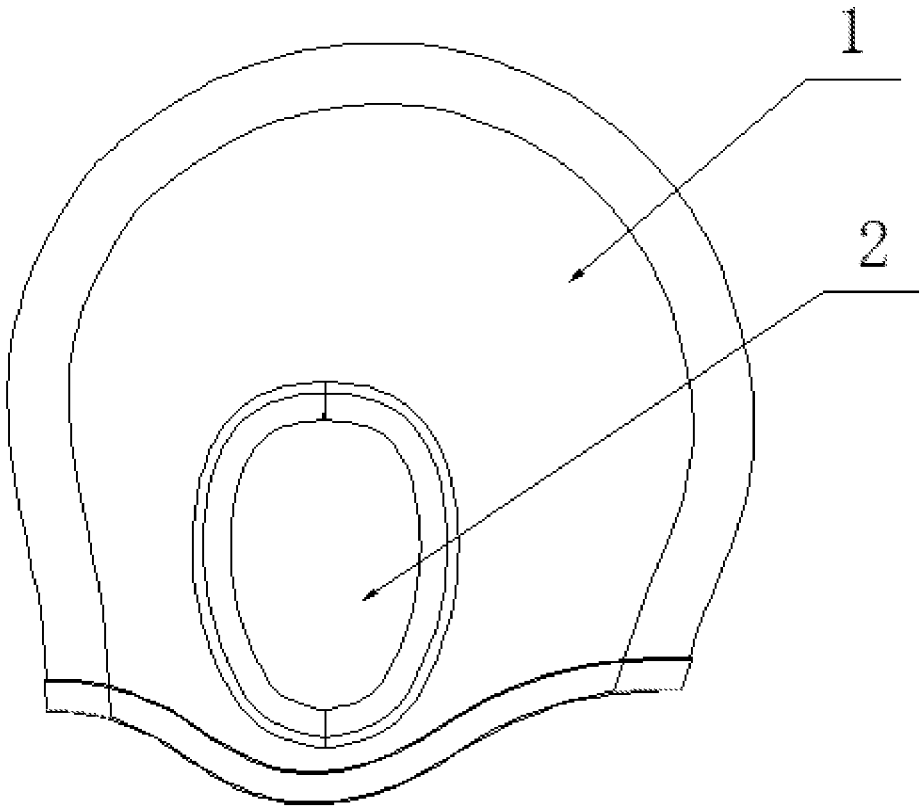
FIG. 2 is a side view of the present invention.
Figure 3:
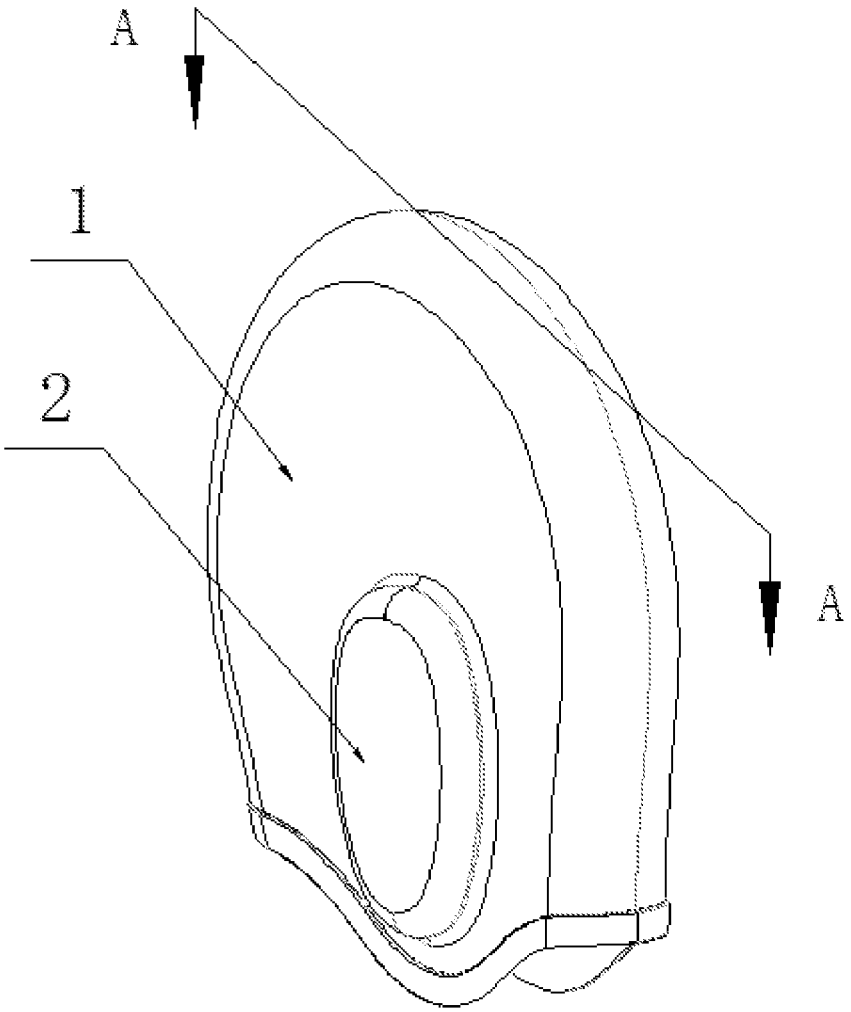
FIG. 3 is a perspective view of the present invention.
Figure 4:
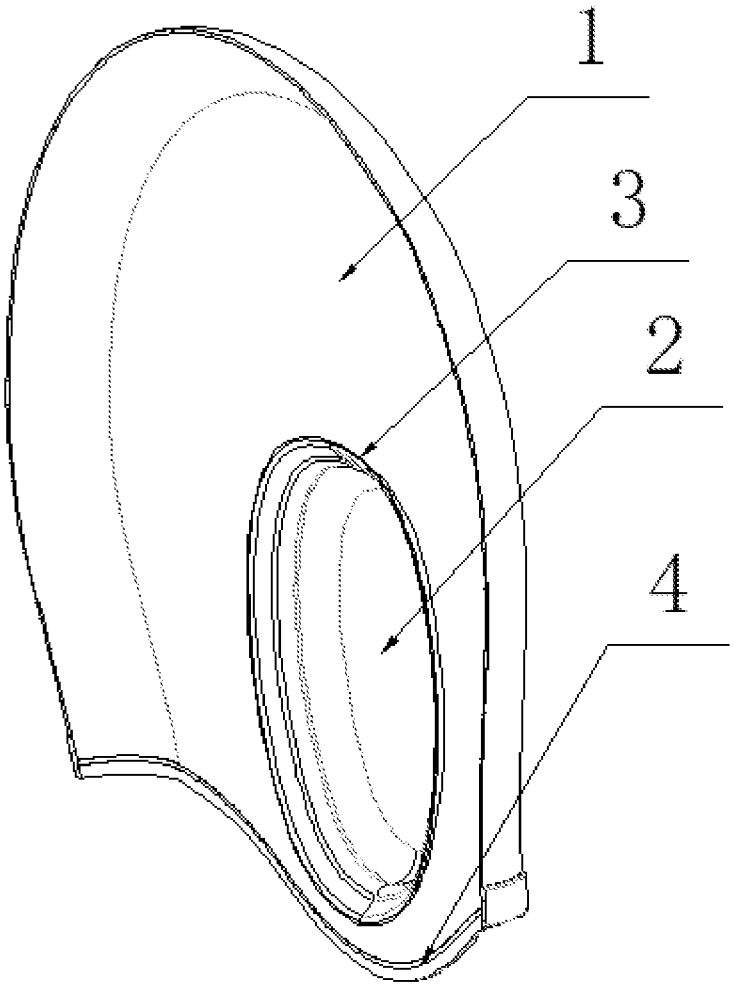
FIG. 4 is a sectional view along A-A of FIG. 3.

As shown in FIGS. 1 to 4, the swimming cap which prevents water from entering ears comprises a swimming cap main body 1. The swimming cap main body 1 has a left side and a right side, each of which is symmetrically provided with an ear enclosing part 2 for accommodating a human ear. Each of the ear enclosing parts 2 has an outer wall which protrudes outwards from an outer wall of the swimming cap main body 1. Each of the ear enclosing parts 2 has an inner wall which forms an enclosing space for enclosing the human ear which protrudes outwards from an inner wall of the swimming cap main body 1. Each of the enclosing spaces has an outer edge which is provided with a waterproof edge 3 in shape of an inclined trumpet at a connecting portion with the swimming cap main body 1. Each of the waterproof edges 3 is a soft edge. The waterproof edges 3 and the swimming cap main body 1 are integrally formed. The swimming cap main body 1 and the ear enclosing parts 2 are integrally formed.

Embodiment 2

The present embodiment is different from Embodiment 1 in that a head portion waterproof edge 4 is additionally provided. More particularly, as shown in the figures, the head portion waterproof edge 4 which is inclined inwards is provided at a lower opening of the swimming cap main body 1. The head portion waterproof edge 4 is a soft edge. The head portion waterproof edge 4 and the swimming cap main body 1 are integrally formed.

The present invention provides a swimming cap which prevents water from entering ears. When in use, the ear enclosing parts 2 and the waterproof edges 3 provided in the inner side isolate the ears from other parts of the head, so that water would not enter the ears during swimming. The head portion waterproof edge 4 increases waterproof level and reduces water seeping. The present invention is simple and compact in structure and highly practical.

The embodiments described above are only preferred embodiments of the present invention and should not be considered as limiting the present invention. Any changes, alternative configurations or improvements that are made within the essence and principle of the present invention should fall within the scope of protection of the present invention.

In addition, it should be understood that while the specification has been described in terms of embodiments, it is not intended that each embodiment includes only one independent technical solution. The specification is prepared in such a way for the purpose of clarity only. The persons skilled in the art should consider the specification as a whole, and various embodiments may be suitably combined to form other embodiments that will be understood by those skilled in the art.

What is claimed is:

1. A swimming cap which prevents water from entering ears comprising a swimming cap main body, wherein the swimming cap main body has a left side and a right side, each of which is symmetrically provided with an ear enclosing part for accommodating a human ear; each of the ear enclosing parts has an outer wall which protrudes outwards from an outer wall of the swimming cap main body; each of the ear enclosing parts has an inner wall which forms an enclosing space for enclosing the human ear which protrudes outwards from an inner wall of the swimming cap main body; each of the enclosing spaces has an outer edge which is provided with a waterproof edge in shape of an inclined trumpet at a connecting portion with the swimming cap main body;

wherein each of the waterproof edges is a soft edge;

wherein the waterproof edges and the swimming cap main body are integrally formed;

wherein the swimming cap main body and the ear enclosing parts are integrally formed.

2. The swimming cap which prevents water from entering ears of claim 1, wherein a head portion waterproof edge which is inclined inwards is provided at a lower opening of the swimming cap main body.

3. The swimming cap which prevents water from entering ears of claim 2, wherein the head portion waterproof edge is a soft edge, and the head portion waterproof edge and the swimming cap main body are integrally formed.

* * * * *